US006628291B1

(12) United States Patent
Edrington et al.

(10) Patent No.: US 6,628,291 B1
(45) Date of Patent: Sep. 30, 2003

(54) METHOD AND APPARATUS FOR DISPLAY REFRESH USING MULTIPLE FRAME BUFFERS IN A DATA PROCESSING SYSTEM

(75) Inventors: Jimmie Darius Edrington, Georgetown, TX (US); Charles Ray Johns, Austin, TX (US); John Alvin Voltin, Austin, TX (US); Dzung Q. Vu, Cedar Park, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/389,200

(22) Filed: Sep. 2, 1999

(51) Int. Cl.[7] ..... G09G 5/36
(52) U.S. Cl. ..... 345/545; 345/539; 345/546
(58) Field of Search ..... 345/539, 545, 345/546, 555, 559

(56) References Cited

U.S. PATENT DOCUMENTS 5,065,368 A * 11/1991 Gupta et al. ..... 365/230.05
5,109,520 A * 4/1992 Knierim
5,351,067 A * 9/1994 Lumelsky et al. ..... 345/191
5,367,632 A * 11/1994 Bowen et al. ..... 395/518
5,492,125 A * 2/1996 Kim et al. ..... 600/443
5,801,705 A * 9/1998 Kato et al. ..... 345/419
5,854,628 A * 12/1998 Nakagawa ..... 345/340
5,870,109 A * 2/1999 McCormack et al. ..... 345/515
6,005,572 A * 12/1999 Kurihara ..... 345/340

* cited by examiner

*Primary Examiner*—Matthew C. Bella
*Assistant Examiner*—Mackly Monestime
(74) *Attorney, Agent, or Firm*—Duke W. Yee; Mark E. McBurney; Betty Formby

(57) ABSTRACT

A frame buffer system includes a first frame buffer containing a first set of pixels, and a second frame buffer containing a second set of pixels. A first register is connected to an output of the first frame buffer, wherein the first register a number of pixels is stored in which a group of bytes of data is stored for each of the number of pixels. A second register is connected to an output of the second frame buffer, wherein the second register a number of pixels is stored in which a group of bytes of data is stored for each of the number of pixels. A selection logic is connected to the first frame buffer and to the second frame buffer. The selection logic selectively selects pixels to be read from the first frame buffer and the second frame buffer into the first register and the second register. A multiplexer has a first input connected to an output of the first register, a second input connected to an output of the second register, and an output configured for connection to a digital to analog converter. The first multiplexer selectively reads the number of pixels from the first register and the second register and a portion of the group of bytes of data for each pixel.

15 Claims, 4 Drawing Sheets

METHOD AND APPARATUS FOR DISPLAY REFRESH USING MULTIPLE FRAME BUFFERS IN A DATA PROCESSING SYSTEM

BACKGROUND OF THE INVENTION

1. Technical Field

The present invention relates generally to an improved data processing system and, in particular, to an improved method and apparatus for refreshing a display. Still more particularly, the present invention provides a method and apparatus for refreshing a display from data in multiple frame buffers.

2. Description of Related Art

In displaying images in a data processing system, a complete image on a display device is formed from a frame, which contains all of the pixels making up the image displayed on the display device. Typically, the pixels for a frame are stored as a matrix of pixels in which the pixels are displayed one line at a time. The entire image is scanned out sequentially by a video controller one line at a time. This scanning is typically performed from the top of the display to the bottom of the display and then back up to the top of the display. The image displayed is typically stored in a buffer, also referred to as a frame buffer. In single port video memories, a screen refresh occurs by reading the pixel data from the memory to send it to a digital to analog converter (DAC) for conversion to analog signals on the display. Such a mechanism is straight forward when only one copy of data is located in a memory, also referred to as a frame buffer. When the frame buffer is double buffered, using a frame buffer A and a frame buffer B, the process becomes more complex. This complexity occurs because the selection of either frame buffer A or frame buffer B may vary on a pixel by pixel basis when traversing the screen during a refresh. Presently, this possibility is accounted for by treating all of the data from frame buffer A and from frame buffer B. This data is sent to the DAC and any associated logic circuit needed to identify which pixels should be selected from which frame buffers for the refresh. This type of data processing requires sufficient band width to send data from both frame buffer A and frame buffer B to the DAC for presentation.

With the advent of large and inexpensive random access memory (RAM) and the increased requirements for shaded color display, the use of frame buffers has become universally accepted. A frame buffer, also often referred to as a video RAM or VRAM, is a large block of memory with two ports. One port is 'read only' and is used to refresh the display. The other port may be bi-directional and can be updated by a number of bits in parallel (bytes, 16 or 32 bits words are often used). Since the data rate required by the display may be very high (90 million bytes per second for a full color system), this is not a simple system and, depending on its price and technology, the maximum data rate at the port connected to the computer may have to be severely restricted.

One solution to increase the maximum data rate is to duplicate the frame-buffer memory, creating a double-buffered system in which the image in one buffer is displayed while the image in the other buffer is computed. Double-buffering allows the central processing unit (CPU) to have uninterrupted access to one of the buffers while the video controller has uninterrupted access to the other. One possible implementation provides multiplexers that connect each frame buffer to the system bus and the video controller.

Double-buffering in this manner is expensive, however, since twice as much memory is needed as for a single-buffered display. Also, the multiplexers that provide dual access to the frame buffers require numerous chips, which increase the size of the system.

However, one problem with double-buffered systems is that the selection of the first frame buffer or the second frame buffer can vary on a pixel by pixel basis when traversing the screen. One method of implementing double-buffered systems involve reading the data from the first buffer, reading the data from the second buffer, and reading the data from a attribute table, and presenting all of the data to a digital to analog converter (DAC) for potential display. This approach, however, uses twice as much memory bandwidth for reading the data, and twice as many nets/pins for accessing the double data to the DAC. Therefore, it would be advantageous to have an approved method and apparatus for selecting data stored in two or more frame buffers for presentation on a display.

SUMMARY OF THE INVENTION

The present invention provides a method and apparatus for a frame buffer system which includes a first frame buffer containing a first set of pixels, and a second frame buffer containing a second set of pixels. A first register is connected to an output of the first frame buffer, wherein the first register a number of pixels is stored in which a group of bytes of data is stored for each of the number of pixels. A second register is connected to an output of the second frame buffer, wherein the second register a number of pixels is stored in which a group of bytes of data is stored for each of the number of pixels. A selection logic is connected to the first frame buffer and to the second frame buffer. The selection logic selectively selects pixels to be read from the first frame buffer and the second frame buffer into the first register and the second register. A multiplexer has a first input connected to an output of the first register, a second input connected to an output of the second register, and an output configured for connection to a digital to analog converter. The first multiplexer selectively reads the number of pixels from the first register and the second register and a portion of the group of bytes of data for each pixel.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
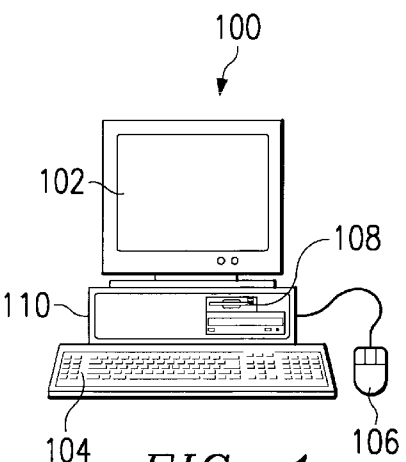
FIG. 1 is a pictorial representation depicting a data processing system in which the present invention may be implemented.

With reference now to the figures and in particular with reference to FIG. 1, a pictorial representation depicting a data processing system in which the present invention may be implemented in accordance with a preferred embodiment of the present invention. A personal computer 100 is depicted which includes a system unit 110, a video display terminal 102, a keyboard 104, storage devices 108, which may include floppy drives and other types of permanent and removable storage media, and mouse 106. Additional input devices may be included with personal computer 100. Personal computer 100 can be implemented using any suitable computer, such as an IBM Aptiva™ computer, a product of International Business Machines Corporation, located in Armonk, N.Y. Although the depicted representation shows a personal computer, other embodiments of the present invention may be implemented in other types of data processing systems, such as network computers, Web based television set top boxes, Internet appliances, etc. Computer 100 also preferably includes a graphical user interface that may be implemented by means of systems software residing in computer readable media in operation within computer 100.

Figure 2:
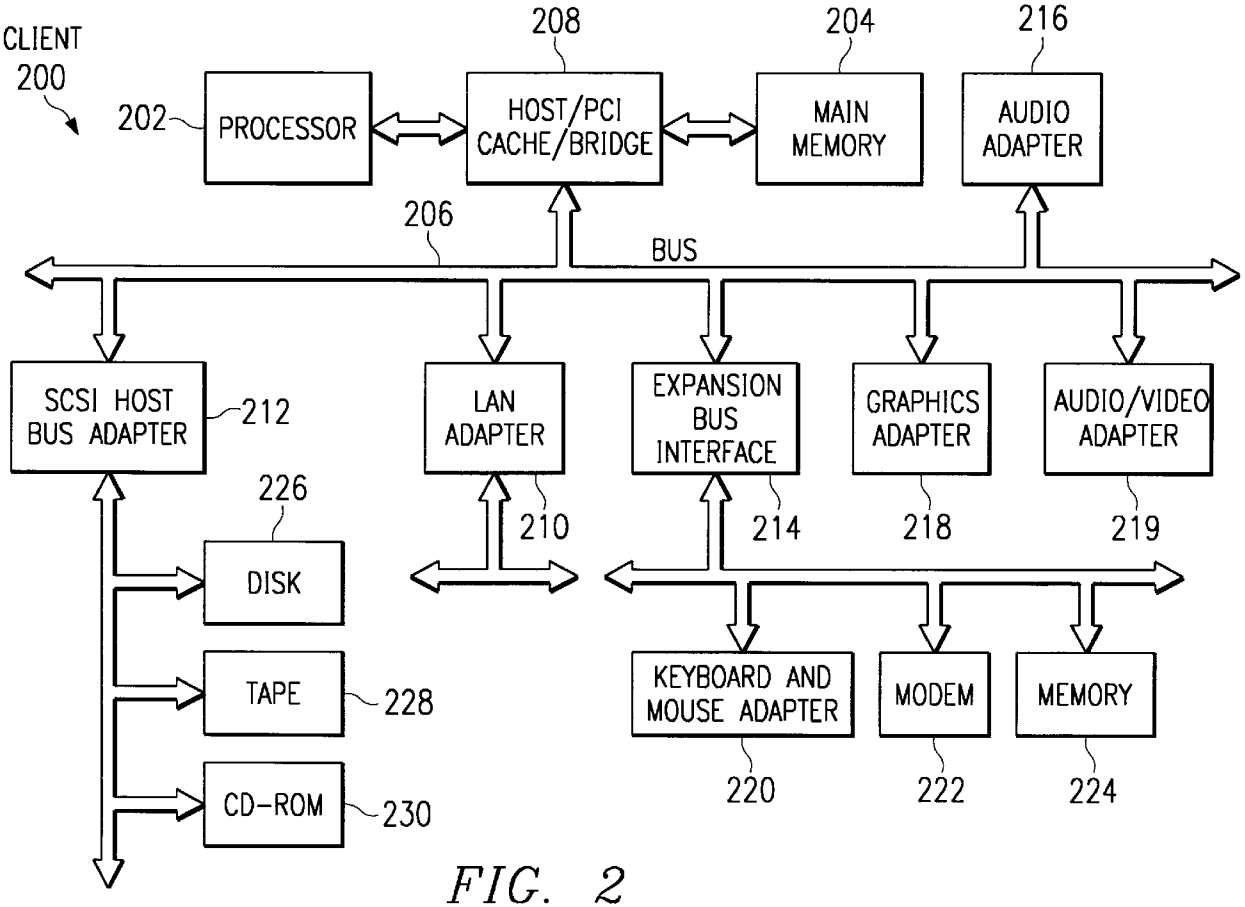
FIG. 2 is a block diagram illustrating a data processing system in which the present invention may be implemented.

With reference now to FIG. 2, a block diagram illustrates a data processing system in which the present invention may be implemented. Data processing system 200 is an example of a computer, such as computer 100 in FIG. 1, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, small computer system interface SCSI host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as OS/2 or Windows 95. OS/2 is available from International Business Machines Corporation. "OS/2" is a trademark of International Business Machines Corporation. Windows 95 is available from Microsoft Corporation. Instructions for the operating system, the object-oriented operating system, and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash ROM (or equivalent nonvolatile memory) or optical disk drives and the like, may be used in addition to or in place of the hardware depicted in FIG. 2. Also, the processes of the present invention may be applied to a multiprocessor data processing system.

As a further example, data processing system 200 may be a personal digital assistant (PDA) device which is configured with ROM and/or flash ROM in order to provide non-volatile memory for storing operating system files and/or user-generated data.

In particular, the method and apparatus of the present invention may be implemented within a graphics adapter, such as graphics adapter 218 in FIG. 2.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

Figure 3:
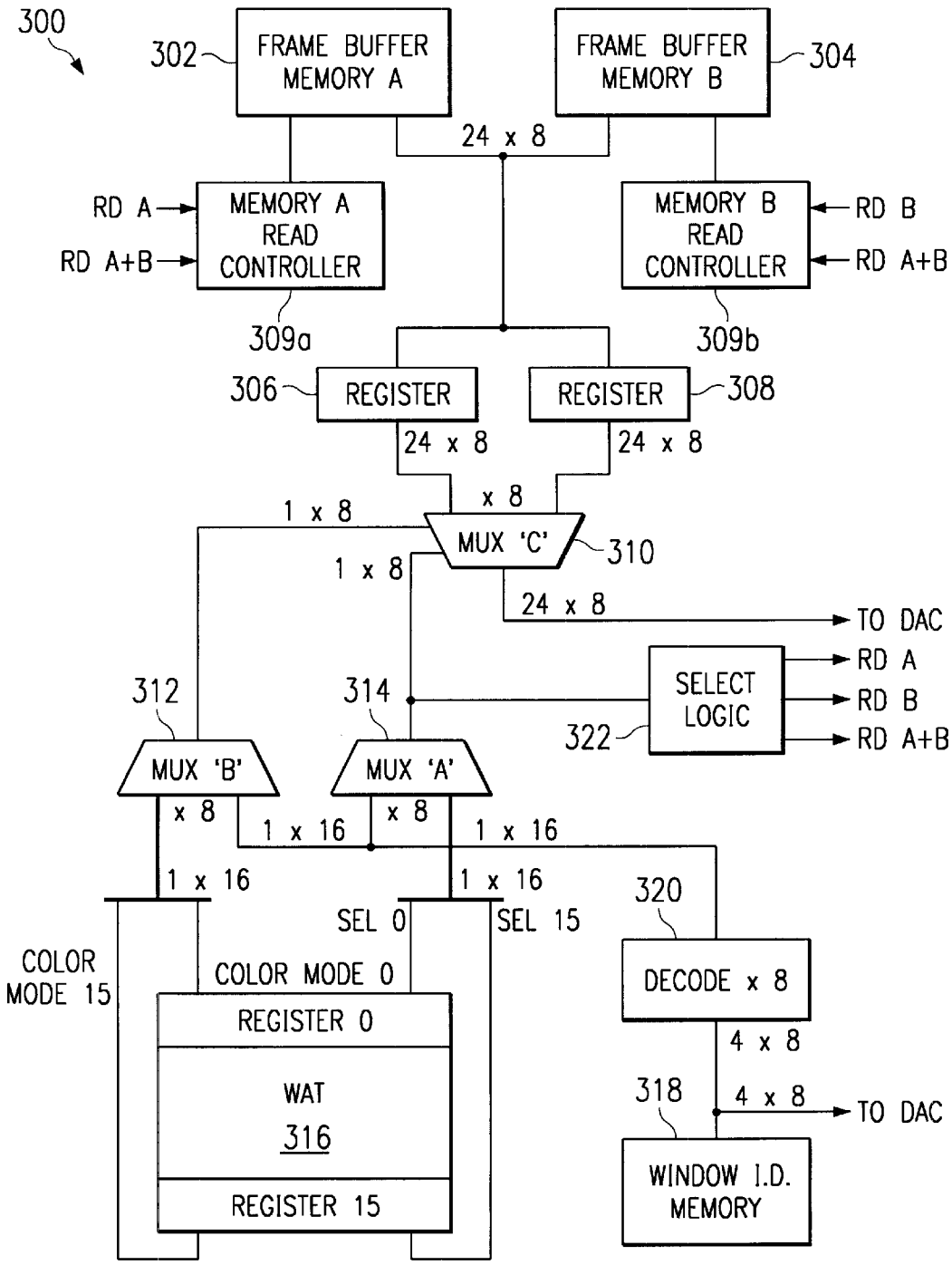
FIG. 3 is a block diagram illustrating a frame buffer system depicted in accordance with a preferred embodiment of the present invention.

Turning now to FIG. 3, a block diagram illustrating a frame buffer system is depicted in accordance with a preferred embodiment of the present invention. Frame buffer system 300 is used to provide double frame buffer merging in accordance with a preferred embodiment of the present invention. Frame buffer system 300 may be found in a graphics adapter, such as graphics adapter 216 in FIG. 2. In the depicted examples, frame buffer system 300, with the exclusion of memories, may be implemented in a single application specific integrated circuit (ASIC). Of course, the processes illustrated with respect to frame buffer system 300 may be applied to frame buffer systems containing more than two frame buffer memories.

In this example, frame buffer system 300 includes a frame buffer A 302 and a frame buffer B 304. These frame buffers are memories used to store pixels that are to be displayed on a screen. Frame buffer A 302 and frame buffer B 304 may be allocated from memory, such as SGRAM, SDRAM, or DRAM, or may be specialized memory units. Register 306 is used to store information from frame buffer A 302 while register 308 stores information from frame buffer B 304. Each of these registers, register 306 and register 308, may store information for up to 8 pixels in which the information for each pixel may be up to 24 bits. Data may be read from frame buffer A 302 into register 306 or from frame buffer B 304 into register 308 using memory read hardware 309. Information may be selectively read from registers 306 and 308 into multiplexer 310 for output to a digital to analog converter (DAC), which is connected to frame buffer system 300.

Frame buffer system 300 also includes multiplexer 312 and multiplexer 314. In particular, multiplexer 312 receives color mode information from window attribute table (WAT) 316. Window attribute table 316 is a collection of registers in which the number of registers is equal to the number of unique windows supported. The bits within a register define various attributes that may vary between registers. For example, one bit within window attribute table 316 identifies which buffer is currently active for display purposes. Another group of bits will define the color mode, such as 8 bits per pixel or 24 bits per pixel for the particular window. Frame buffer system 300 also includes a window ID memory 318 and a decoder unit 320.

Multiplexer 314 is used to retrieve information identifying the frame buffer memory from which information should be selected for displaying a particular pixel. Multiplexer 314 is used to retrieve data for eight pixels in which one bit of data is retrieved for each of the eight pixels from registers within window attribute table 316. The particular registers selected are identified from the output of decoder unit 320. The output of multiplexer 314 is also used as an input into select logic 322. If all of the bits output from multiplexer 314 for all 8 pixels are "0", then data is retrieved only from frame buffer A. If all of the bids output by multiplexer 314 are a logic "1", then data is read only from frame buffer B 304. If neither situation is present, then data is read from both frame buffer A 302 and frame buffer B 304 based on the output from select logic 322. Select logic 322 generates signals Rd A, Rd B, and Rd A+B depending on which frame buffers are to be read. Rd A is generated when data is to be read from frame buffer memory A 302 while Rd B is generated when data is to be read from frame buffer memory B 304. Rd A+B is generated when both frame buffer memories are to be read. Memory A read controller 309*a* and memory read controller 309*b* are used to read data from frame buffer memory A 302 and frame buffer memory B 304, respectively. The data is read by commands sent from the read controllers to the frame buffer memories. Memory A read controller 309*a* receives a Rd A signal and a Rd A+B signal from select logic 322. Memory B read controller 309*b* receives a Rd B signal and a Rd A+B signal from select logic 322.

Window ID (WID) memory 316 is a buffer that stores data for each pixel in the screen, which identifies the window with which a pixel is associated. The output of decoder 320 is used to control the memory read operations that need to be performed. Four bits input for each of the eight pixels into decoder 320 is used to select a register for reading color mode data for each of the group of eight pixels into multiplexer 312 in the depicted examples. This identification is used when different windows have different attributes.

For example, one window may have 8 bits to describe color, whereas another window may use 24 bits to describe the color for the pixel. In this example, window ID memory 318 provides the data in a bit format to the DAC.

Frame buffer A 302 and frame buffer B 304 store the digital form of the screen image in which each pixel or dot has one or more bytes of data describing the pixel, such as, for example, the color of the pixel and/or the palette address of the pixel. With dynamic three dimensional applications, two frame buffers, frame buffer A 302 and frame buffer B 304, are needed because of the time required to compute a new screen image. In such a case, one frame buffer is used to build a new screen image while the contents of the other frame buffer are displayed. The control of frame buffer A 302 and frame buffer B 304 in these examples are for illustrative purpose only. The same mechanism illustrated by the depicted examples may be used to merge other types of data, including overlays and/or stereo screen buffer data.

Multiplexer 310 may pass up to 24 bits of information for 8 pixels at a time to the DAC. Pixels are passed from the frame buffer memories to the DAC at a rate of 8 pixels per cycle in these examples. In these examples, each register may pass up to 8 pixels of information at a time to multiplexer 310 in which each pixel may include up to 24 bits of information. Data may be read from frame buffer A 302 and frame buffer B 304 8 pixels at a time in these examples in which each pixel may include up to 24 bits of information.

Decode unit 320 is used to decode the data from window ID memory 318 into information used to select the appropriate register within window attribute table 316. In the depicted examples, window attribute table 316 includes 16 registers, which correspond to 16 different independent windows.

For each group of 8 pixels, 8 hardware bits are generated, which define a mixture of frame buffer A 302 and frame buffer B 304 across 8 pixels that are to be sent to the DAC. Three possible cases exist. All 8 pixels may be obtained from frame buffer A 302 or all 8 pixels may be obtained from frame buffer B 304. A third situation exists in which some of the pixels are obtained from frame buffer A 302 while other pixels in the group of 8 pixels are obtained from frame buffer B 304. It is rare for a group of 8 consecutive pixels in a horizontal scan line to contain pixels from both frame buffer A 302 and frame buffer B 304 because a change from one to the other on consecutive pixels only occurs when a window boundary is encountered between the two pixels. This situation follows because within a single window, the frame buffer selection is fixed for one scan of the screen.

For example, if a group of 8 pixels requires a selection of "ABABABAB" in which "A" represents a pixel from frame buffer A 302 and "B" represents a pixel from frame buffer B 304, then each window is only one pixel wide, which would be quite unusual. The 8 hardware bits are generated as follows based on example of four bits from window ID memory 318 in a corresponding 16 registers from window attribute table 316. The first 16 buffer select bits are multiplexed via the window ID bits down to a composite 8 bit buffer selection field using multiplexer 314 for the 8 pixels. The same process is performed for the color mode bits with respect to the output of multiplexer 312.

In the present examples, 24 color bits are present per pixel. The outputs of multiplexer 314 and the output of multiplexer 312 control the data multiplexer 310 to select data either from frame buffer A 302 or frame buffer B 304. The merged data output for multiplexer 310 and the output of information from window ID memory 318 are passed to the DAC to display the group of pixels.

Figure 4:
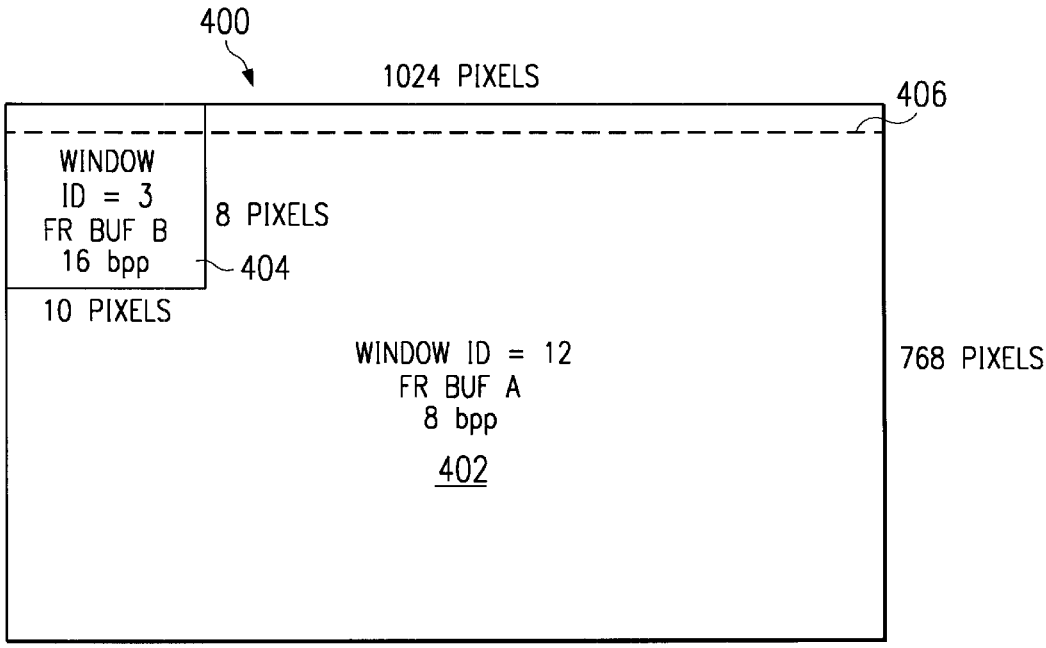
FIG. 4 is an example of a screen image on a display depicted in which the processes of the present invention select pixels for display on the screen.

If a group of all 8 pixels is all from one frame buffer or another frame buffer, a single read is performed. In the case that a mixture of pixels from frame buffer A 302 and frame buffer B 304 are present, the memory read hardware reads from both frame buffer A 302 and frame buffer B 304 and stores that data in registers 306 and 308 in the depicted examples. With reference now to FIG. 4, an example of a screen image on a display is depicted in which the processes of the present invention select pixels for display on the screen. In this example, screen 400 is 1024 pixels wide by 768 pixels high. Screen 400 includes a window 402 and a window 404 in this example. Window 402 is displayed using pixels from a first frame buffer while window 404 is displayed using pixels obtained from a second frame buffer. In this example, window 404 is 10 pixels wide and 8 pixels high. Window 402 has a window ID of 12 and the pixels for this window are located in frame buffer A. The color mode is 8 bits per pixel for window 402. In window 404, the window ID is 3. The information for window 404 indicates that pixels are to be read from frame buffer B and the color mode is 16 bits per pixel for this particular example. Scan line 406 is the first scan line that is read from the frame buffers when refreshing display 400.

Figure 5:
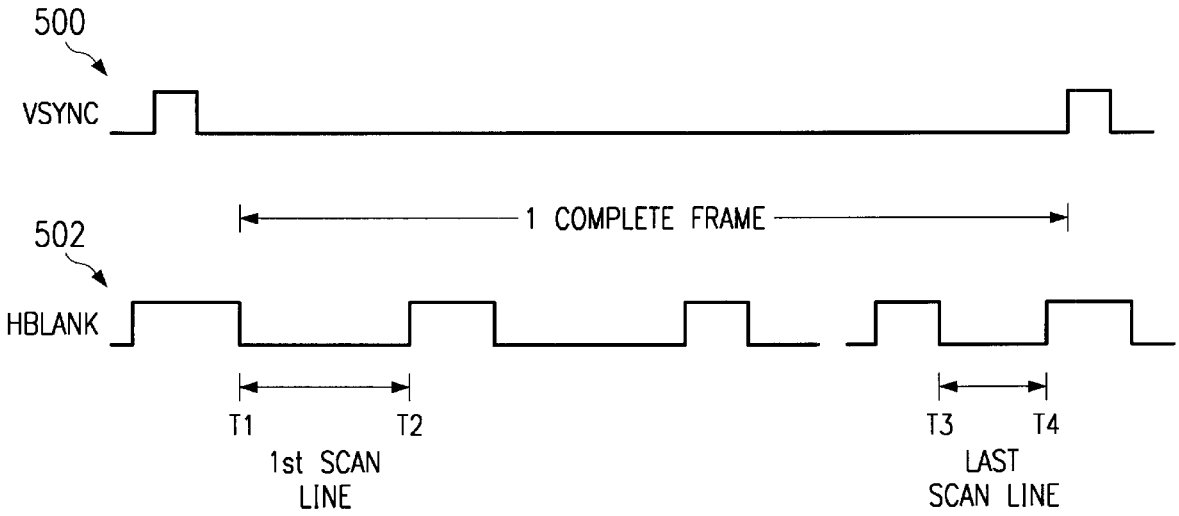
FIG. 5 is a timing diagram illustrating horizontal and vertical timing signals depicted in accordance with a preferred embodiment of the present invention.

Turning now to FIG. 5, a timing diagram illustrating horizontal and vertical timing signals is depicted in accordance with a preferred embodiment of the present invention. Vertical timing signal 500 illustrates the timing for vertical synchronization while horizontal blank (hblank) signal 502 illustrates the timing used in presenting scan lines on the display. When hblank signal 502 is high, information is not being displayed on the screen. Information for a scan line is displayed between a high to low transition in hblank signal 502. The first scan line is displayed between times T1 and T2 while, in this example, the last scan line is shown being displayed between times T3 and T4. A complete frame is displayed on the screen between times T1 and T4 in this example.

Figure 6:
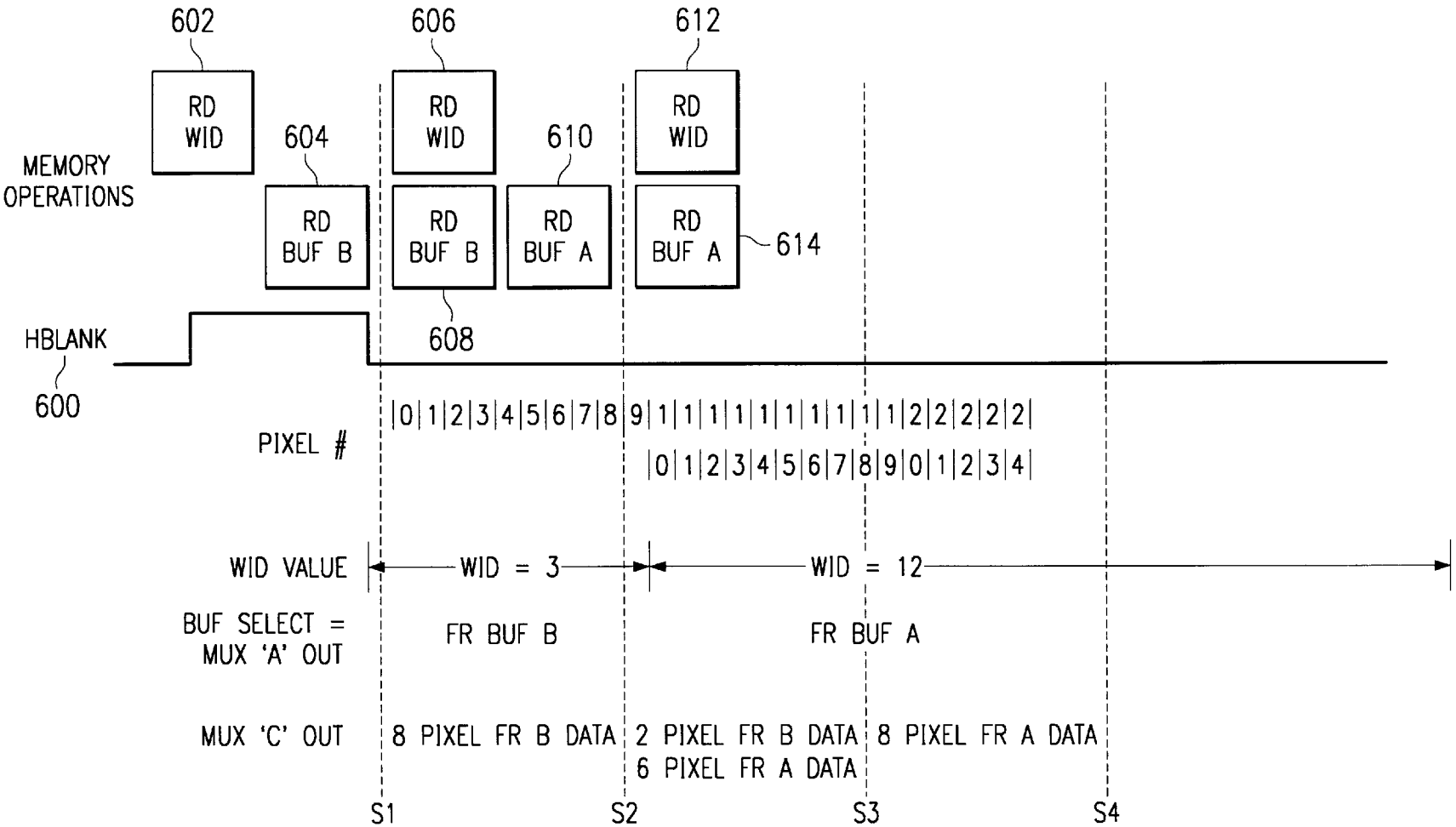
FIG. 6 is a timing diagram illustrating the display of a first scan line illustrated in accordance with a preferred embodiment of the present invention.

Turning now to FIG. 6, a timing diagram illustrating the display of a first scan line is illustrated in accordance with a preferred embodiment of the present invention. In FIG. 6, hblank signal 600 illustrates the timing used to display a scan line, such as scan line 406 in FIG. 4.

In this example, memory operations read window ID 602 and read buffer B 604 occur during the high portion of hblank signal 600. During this time, the window ID value is used to select information from frame buffer B only. Based on this selection, the first 8 pixels are written to the screen in 8 pixel increments during time S1 to time S2. The entire 8 pixels of this information are obtained from frame buffer B. The memory operations occurring during the display of the first 8 pixels include a read window ID 606, a read buffer B 608, and a read buffer A 610. This information is used to display the pixels during times S2 and S3 in this example. Between times S2 and S3, the information read from frame buffers A and B are displayed on the screen. During this time period, memory operations are performed to display the next set of pixels. During times S2 and S3, a read window ID 612 and a read buffer A 614 occur. Information from these reads are displayed between times S3 and times S4.

Other solutions to this problem have involved reading data from both frame buffers along with the window ID data and presenting all of this information to the DAC logic for the display. This approach, however, uses twice as much memory bandwidth for reading data and twice as many net/pens for transferring this data to the DAC.

The present invention reads memory twice for eight pixels only when necessary. As a result, a 50-percent savings in memory bandwidth and nets/component pins required to transport information to the DAC is accomplished.

It is important to note that while the present invention has been described in the context of a fully functioning data processing system, those of ordinary skill in the art will appreciate that the processes of the present invention are capable of being distributed in a form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. Although the depicted examples illustrate only two frame buffers, the processes of the present invention may be applied to managing other numbers of frame buffers greater than two. Additionally, other number of bits of data and groups of pixels other than those illustrated may be processed using the processes of the present invention. The embodiment was chosen and described in order to best explain the principles of the invention the practical application and to enable others of ordinary skill in the art to understand the invention for various embodiments with various modifications as are suited to the particular use contemplated.

What is claimed is:

1. A frame buffer system comprising:

a first frame buffer containing a first set of pixels;

a second frame buffer containing a second set of pixels;

a first register connected to an output of the first frame buffer, wherein the first register stores a number of pixels in which a group of bytes of data is stored for each of the number of pixels;

a second register connected to an output of the second frame buffer, wherein the second register stores a number of pixels in which a group of bytes of data is stored for each of the number of pixels;

a selection logic connected to the first frame buffer and to the second frame buffer, wherein the selection logic selectively selects pixels to be read from the first frame buffer and the second frame buffer into the first register and the second register; and a multiplexer having a first input connected to an output of the first register, a second input connected to an output of the second register, and an output configured for connection to a digital to analog converter, wherein the multiplexer selectively reads the number of pixels from the first register and the second register and a portion of the group of bytes of data for each pixel wherein the multiplexer is a first multiplexer and further comprising:

a second multiplexer having an output connected to the first multiplexer, wherein the second multiplexer controls which register pixels are output by the first multiplexer; and a third multiplexer having an output connected to the first multiplexer, wherein the third multiplexer controls how many bytes within the group of bytes of data are output for each pixel by the first multiplexer.

2. A frame buffer system comprising:

a first frame buffer containing a first set of pixels;

a second frame buffer containing a second set of pixels;

a first register connected to an output of the first frame buffer, wherein the first register stores a number of pixels in which a group of bytes of data is stored for each of the number of pixels;

a second register connected to an output of the second frame buffer, wherein the second register stores a number of pixels in which a group of bytes of data is stored for each of the number of pixels;

a selection logic connected to the first frame buffer and to the second frame buffer, wherein the selection logic selectively selects pixels to be read from the first frame buffer and the second frame buffer into the first register and the second register; and a multiplexer having a first input connected to an output of the first register, a second input connected to an output of the second register, and an output configured for connection to a digital to analog converter, wherein the multiplexer selectively reads the number of pixels from the first register and the second register and a portion of the group of bytes of data for each pixel; and a window attribute table, wherein the window attribute table contains attribute information for pixels for a plurality of windows including information identifying a frame buffer in which the pixels for a window within the plurality of windows is located and wherein the second multiplexer has an input for receiving information identifying the frame buffer.

3. The frame buffer system of claim 2, wherein the multiplexer selects pixel data only from the first register.

4. The frame buffer system of claim 2, wherein the multiplexer selects pixel data only from the second register.

5. The frame buffer system of claim 2, wherein the multiplexer selects pixel data from both the first register and the second register.

6. The frame buffer system of claim 2, wherein the selection logic selects pixel data to be read only from the first frame buffer to the first register.

7. The frame buffer system of claim 2, wherein the selection logic selects pixel data to be read only from the second frame buffer to the second register.

8. The frame buffer system of claim 2, wherein the selection logic selects pixel data to be read from the first frame buffer to the first register and from the second frame buffer to the second register.

9. The frame buffer system of claim 2, wherein the selection logic selects pixel data from the first frame buffer and the second frame buffer based on an identification of a window in which pixel data is located.

10. The frame buffer system of claim 2, wherein the window attribute table includes color mode information identifying how many bytes of color are used for pixels in a window and wherein the third multiplexer has an input for receiving color byte information.

11. The frame buffer system of claim 10, wherein the window attribute table has a plurality of registers, wherein each register within the plurality of registers stores information for a window within the plurality of windows and further comprising:

a window identification memory having a connection to the second multiplexer and to the third multiplexer, wherein the window identification memory includes information used to identify a register within the plurality of registers from which the second multiplexer obtains information to control which register pixels are output by the first multiplexer and from which the third multiplexer obtains information to control how many bytes within the group of bytes of data are output for each pixel.

12. The frame buffer system of claim 10, wherein the group of bytes is color data.

13. The frame buffer system of claim 10, wherein the group of bytes is intensity data.

14. The frame buffer system of claim 10, wherein the portion of the group of bytes is all of the group of bytes.

15. A frame buffer system comprising:

a first frame buffer containing a first set of pixels;

a second frame buffer containing a second set of pixels;

a first register connected to an output of the first frame buffer, wherein the first register stores a number of pixels in which a group of bytes of data is stored for each of the number of pixels;

a second register connected to an output of the second frame buffer, wherein the second register stores a number of pixels in which a group of bytes of data is stored for each of the number of pixels;

a selection logic connected to the first frame buffer and to the second frame buffer, wherein the selection logic selectively selects pixels to be read from the first frame buffer and the second frame buffer into the first register and the second register, and a multiplexer having a first input connected to an output of the first register, a second input connected to an output of the second register, and an output configured for connection to a digital to analog converter, wherein the multiplexer selectively reads the number of pixels from the first register and the second register and a portion of the group of bytes of data for each pixel;

a third frame buffer containing a third set of pixels;

a third register connected to an output of the third frame buffer, wherein the third register stores a number of pixels in which a group of bytes of data is stored for each of the number of pixels, wherein the first multiplexer has a third input connected to the third register and also wherein the first multiplexer selectively reads the number of pixels from the third register in addition to the first register and the second register and a portion of the group of bytes of data for each pixel.

* * * * *